US010472113B2

(12) United States Patent
Jörissen

(10) Patent No.: US 10,472,113 B2
(45) Date of Patent: Nov. 12, 2019

(54) DEVICE FOR TRANSPORTING SEPARATING ELEMENTS AND INSERTING SEPARATING ELEMENTS INTO PACKAGING UNITS

(71) Applicant: KHS GmbH, Dortmund (DE)

(72) Inventor: Michael Jörissen, Bedburg-Hau (DE)

(73) Assignee: KHS GmbH, Dortmund (DE)

( * ) Notice: Subject to any disclaimer, the term of this patent is extended or adjusted under 35 U.S.C. 154(b) by 416 days.

(21) Appl. No.: 14/909,207

(22) PCT Filed: Jul. 28, 2014

(86) PCT No.: PCT/EP2014/066186
§ 371 (c)(1),
(2) Date: Feb. 1, 2016

(87) PCT Pub. No.: WO2015/014798
PCT Pub. Date: Feb. 5, 2015

(65) Prior Publication Data

US 2016/0194104 A1 Jul. 7, 2016

(30) Foreign Application Priority Data

Jul. 30, 2013 (DE) ..... 10 2013 108 177

(51) Int. Cl.
*B65B 61/20* (2006.01)
*B65B 35/44* (2006.01)
(Continued)

(52) U.S. Cl.
CPC ..... *B65B 61/207* (2013.01); *B65B 35/44* (2013.01); *B31B 50/81* (2017.08); *B31B 2105/00* (2017.08); *B31B 2120/25* (2017.08)

(58) Field of Classification Search
CPC ... B65B 61/207; B65B 21/00–22; B65G 9/04; B65G 54/02; B65H 5/085; B65H 5/14; Y10S 493/912
(Continued)

(56) References Cited

U.S. PATENT DOCUMENTS 2,615,289 A * 10/1952 Hickin ..... B65B 61/207 53/147
3,190,048 A * 6/1965 Ganz ..... B65B 61/207 53/398
(Continued)

FOREIGN PATENT DOCUMENTS

DE 23 31 193 1/1975
DE 2356319 A1 * 5/1975 ..... B31B 50/00
(Continued)

*Primary Examiner* — Gloria R Weeks
*Assistant Examiner* — Dariush Seif
(74) *Attorney, Agent, or Firm* — Occhiuti & Rohlicek LLP

(57) ABSTRACT

A transport device transports a separating element and inserts it into a container having receptacles. The separating element thus separates adjacent receptacles from each other. The apparatus includes a transport device that removes a separating element from a magazine and brings it to an insertion station for insertion into the container. The transport device includes a linear transporter having an electromagnetic direct drive and motion elements that circulate in a common direction around the linear transporter's closed motion path. Each motion element has a gripper arranged thereon.

24 Claims, 7 Drawing Sheets

(51) Int. Cl.
*B31B 50/81* (2017.01)
*B31B 120/25* (2017.01)
*B31B 105/00* (2017.01)

(58) Field of Classification Search
USPC ..... 53/157, 263, 238, 443, 445; 198/619, 198/459.8, 373, 375, 377.07, 377.08, 198/474.1, 475.1, 867.03, 462.2, 460.1, 198/418.9
See application file for complete search history.

(56) References Cited

U.S. PATENT DOCUMENTS 3,350,836 A * 11/1967 Dillon ..... B65B 61/207 493/391
3,473,295 A * 10/1969 Nigrelli ..... B65B 61/207 493/391
3,483,802 A * 12/1969 Heyne ..... B31B 50/00 198/468.8
3,589,497 A * 6/1971 Leach ..... B65G 17/123 198/459.8
3,621,765 A * 11/1971 Sootheran et al. ..... B31B 50/00 493/91
3,680,278 A * 8/1972 Pearson ..... B65B 61/207 53/445
3,694,994 A * 10/1972 Corderoy ..... B65B 21/00 53/157
3,803,993 A * 4/1974 Graham ..... B31B 50/00 414/736
3,872,647 A * 3/1975 Langen ..... B65B 21/06 198/419.3
3,952,633 A * 4/1976 Nakai ..... B65B 61/207 493/91
4,292,034 A * 9/1981 Probyn ..... B31D 5/0004 493/125
4,527,376 A * 7/1985 Mauger ..... B65B 27/08 493/311
4,763,462 A * 8/1988 Johnson, Jr. ..... B65B 61/207 493/312
4,793,117 A * 12/1988 Raudat ..... B65B 21/24 53/157
4,829,747 A * 5/1989 Johnson, Jr. ..... B65B 61/207 493/91
4,878,337 A * 11/1989 Raudat ..... B65B 21/24 53/534
4,962,625 A * 10/1990 Johnson, Jr. ..... B65B 35/44 198/419.1
4,996,821 A * 3/1991 Crowe ..... B65B 61/207 493/90
5,485,713 A * 1/1996 Moncrief ..... B65B 61/207 53/157
5,626,002 A * 5/1997 Ford ..... B65B 21/242 53/398
5,761,882 A * 6/1998 Gambetti ..... B65B 61/207 53/157
5,862,648 A * 1/1999 Greenwell ..... B65B 61/207 53/157
6,128,886 A * 10/2000 Johnson, Jr. ..... B65B 61/207 493/91
6,309,334 B1 * 10/2001 Planas Xapelli .. B65D 5/48026 493/150
7,302,785 B2 * 12/2007 Heuvel ..... B65B 61/207 493/91
7,401,453 B2 * 7/2008 Ford ..... B65B 21/242 53/251
7,726,464 B2 6/2010 Cerf
9,051,132 B2 * 6/2015 van de Loecht ..... B65G 47/31
9,061,838 B2 * 6/2015 van de Loecht ..... B65G 47/31
9,079,724 B2 * 7/2015 van de Loecht ..... B65G 47/841
9,290,292 B2 * 3/2016 Sain ..... B65B 61/207
2004/0068961 A1 * 4/2004 Chalendar ..... B65B 61/207 53/398
2004/0237469 A1 * 12/2004 Serras Vila ..... B65B 21/02 53/263
2005/0235607 A1 * 10/2005 Van Den Heuvel ..... B65B 61/207 53/415
2007/0084149 A1 * 4/2007 Jorissen ..... B65B 61/207 53/471
2008/0034709 A1 * 2/2008 Chalendar ..... B65B 61/207 53/383.1
2010/0084247 A1 * 4/2010 Wipf ..... B65G 19/02 198/617
2010/0180544 A1 * 7/2010 Devaux ..... B65B 39/006 53/251
2013/0274081 A1 * 10/2013 Sain ..... B65B 61/207 493/374
2014/0083817 A1 * 3/2014 van de Loecht ..... B65G 47/841 198/459.8

FOREIGN PATENT DOCUMENTS

DE 4034639 A1 * 5/1991 ..... B65B 61/207
DE 41 26 212 2/1993
DE 103 53 103 6/2005
DE 10353103 A1 * 6/2005 ..... B65B 61/207
DE 10 2005 046246 4/2007
DE 10 2006 037 105 2/2008
DE 10 2007 062844 6/2009
DE 10 2009 025 824 11/2010
DE 10 2009 044 271 4/2011
DE 10 2012 005925 11/2012
DE 10 2011 106761 1/2013
DE 10 2011 081 705 2/2013
DE 10 2011 119968 6/2013
EP 1410995 A1 * 4/2004 ..... B65B 21/18
EP 1529728 A1 * 5/2005 ..... B65B 61/207
EP 2 096 039 9/2009
EP 2 500 296 9/2012
WO WO 2012150087 A1 * 11/2012 ..... B65G 47/841

* cited by examiner

DEVICE FOR TRANSPORTING SEPARATING ELEMENTS AND INSERTING SEPARATING ELEMENTS INTO PACKAGING UNITS

RELATED APPLICATIONS

This is the U.S. national stage of international application PCT/EP2014/066186, filed on Jul. 28, 2014, which claims the benefit of the Jul. 30, 2013 priority date of German application DE 102013108177.0, the contents of which are herein incorporated by reference.

FIELD OF INVENTION

The invention relates to container packaging, and in particular, to transporting separating elements that are used to separate adjacent receptacles from each other within a container.

BACKGROUND

Receptacles for containing a product are sometimes packaged together in containers. Sometimes, during the course of transport, these receptacles can hit each other. This can result in breakage and excessive noise during transport.

To solve this problem, it is known to put separating elements between receptacles. One approach is to place the separating element in a container and to then place the receptacles into the compartments formed by the separating element. However, a better approach for mass production is to place the separating element over the receptacles.

SUMMARY

In one aspect, the invention features a transport device that transports a separating element and inserts it into a container that has receptacles. The separating element thus separates adjacent receptacles from each other. The apparatus includes a transport device that removes a separating element from a magazine and brings it to an insertion station for insertion into the container. It also includes a linear transporter having an electromagnetic direct drive and motion elements that circulate in a common direction around the linear transporter's closed motion path. Each motion element has a gripper arranged thereon.

In another aspect, the invention features an apparatus for transporting a separating element and inserting a separating element into a container containing a receptacle group that comprises a plurality of receptacles, adjacent ones of which are to be separated by the separating element. Such an apparatus includes a transport device configured to pick up the separating element and to bring the separating element to the container. The transport device comprises a linear transporter, which is implemented as an electromagnetic direct drive. The linear transporter comprises a closed motion path on which motion elements circulate in a common direction. Each motion element has a gripper arranged thereon.

In some embodiments, the closed motion path comprises an outgoing side, a return side, and first and second deflection regions arranged between the return side and the outgoing side.

Other embodiments include those in which each motion element has a gripper arranged thereon. This gripper is movable relative to both the linear transporter and to the first motion element. Some of these embodiments have two or more grippers, all of which are controllable independently of each other.

In other embodiments, each motion element is individually actuatable along the closed motion path independently of other motion elements.

Further embodiments have a magazine. In these embodiments, the motion elements, all of which have at least one gripper, are configured to remove a separating element from the magazine. Among these embodiments are those in which the separating element is a frame.

In yet other embodiments, a portion of the linear transporter defines an insertion station at which separating elements are placed into waiting containers.

Additional embodiments are those in which a first portion of the linear transporter defines a transfer station and a second portion defines an insertion station. The insertion station is where separating elements are placed into waiting containers, and the transfer station is where the separating elements are picked up before being brought to the insertion station.

One kind of separating element is a frame. A frame has at least one longitudinal web and at least one transverse web. Other kinds of separating element include an individual web that is conveyed to the container, and a plurality of individual webs connected to each other.

As used herein, a receptacle refers to such structures as bottles, cans, tubes, and/or pouches, whether made of metal, glass, and/or plastic, including, for example, PET bottles. Receptacles also include packaging elements that are suitable for filling with fluid or viscous products, and for accommodating foodstuffs, as well as receptacles that have been assembled into groups, such as multipacks.

Further embodiments, advantages, and possible applications of the invention are also derived from the following description of exemplary embodiments. In this situation, all the features described are essentially the object of the invention, individually or in any desired combination, regardless of their association in the claims or references to them. The contents of the claims are also a constituent part of the description.

These and other features and advantages will be apparent from the following detailed description and the accompanying figures, in which:

DETAILED DESCRIPTION

Figure 1:
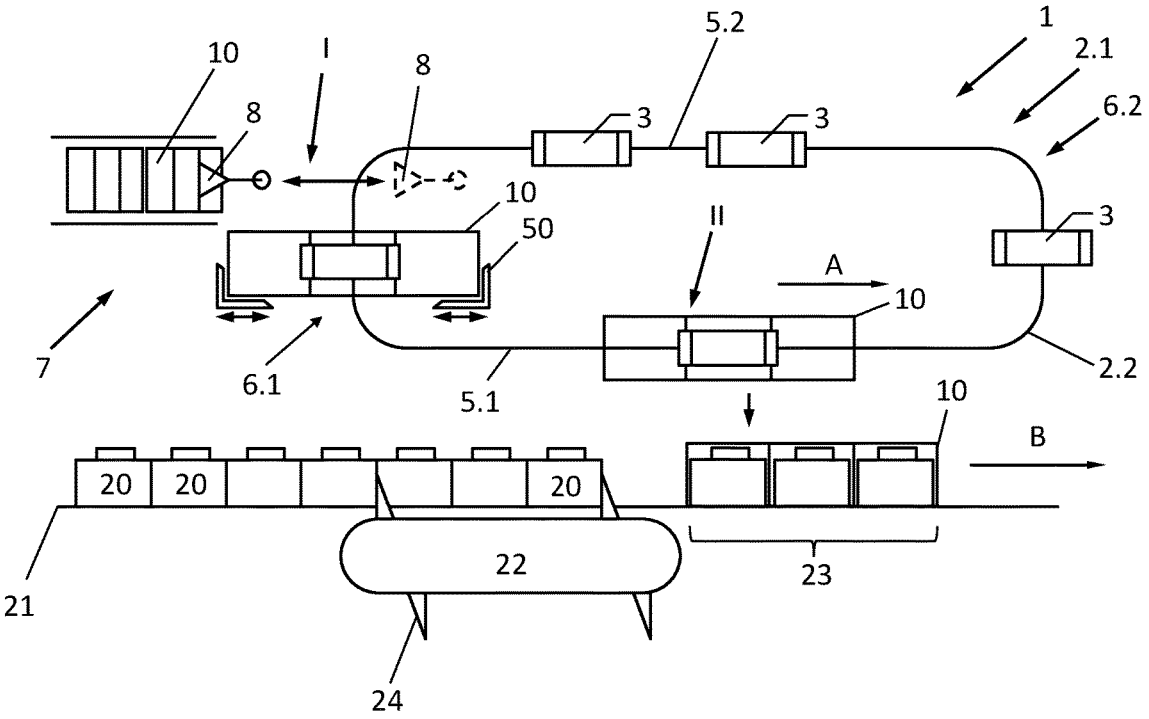
FIG. 1 shows a device for transporting and inserting separating elements.
Figure 7:
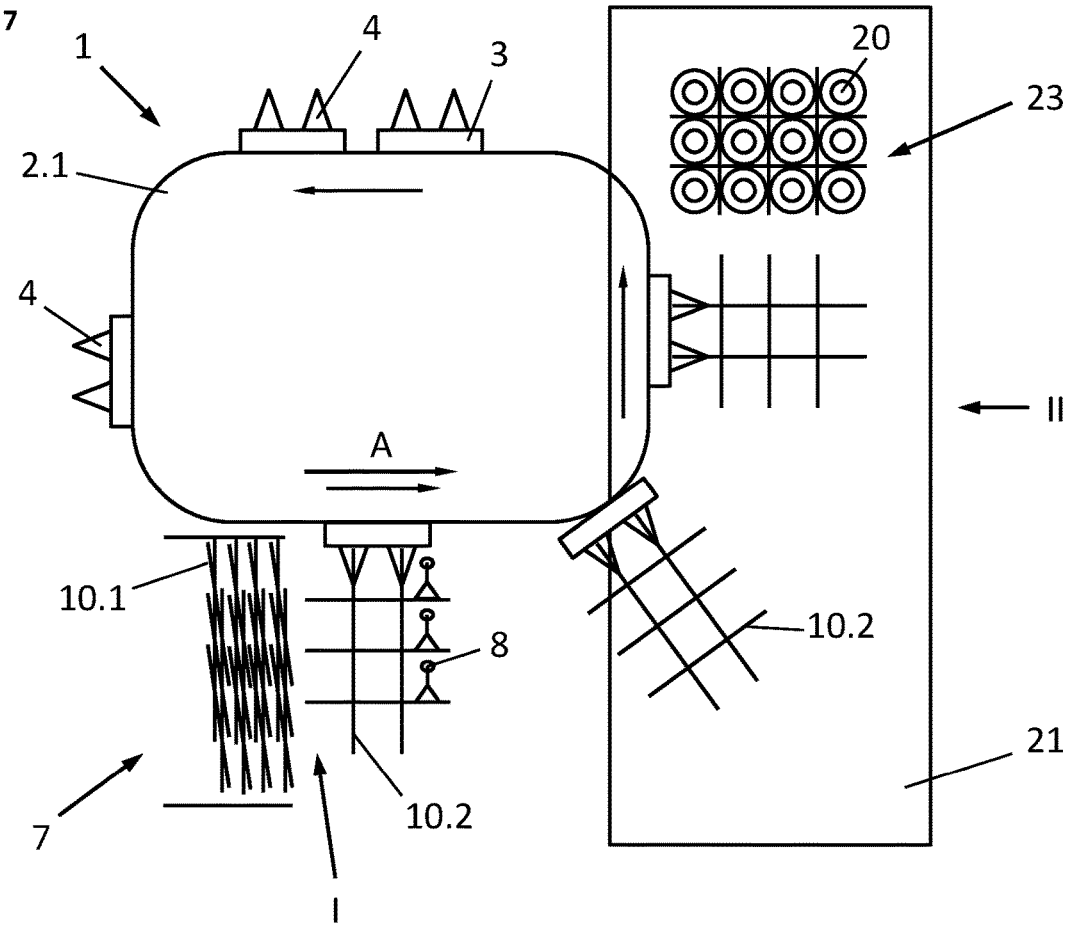
FIG. 7 shows an additional embodiment of a device for transporting and inserting separating elements, with a horizontal motion path.

FIGS. 1 and 7 show a transport device 1 for transporting separating elements 10. The transport device 1 inserts these separating elements 10 into containers 23 that hold a group of receptacles 20. These separating elements 10 thus separate adjacent receptacles 20 from each other within the container 23. In the course of its operation, the transport device 1 removes a separating element 10 from a magazine 7 located at a transfer station I and transports it to an insertion station II. At the insertion station II the separating element 10 is inserted into the container 23.

The transport device 1 for transporting and inserting separating elements 10 includes a linear transporter 2.1 that defines a closed motion path 2.2 along which motion elements 3 move. In some embodiments, these motion elements 3 are carriages, whereas in others, they are movers. Each motion element 3 has at least one mechanical gripper 4, best seen in FIG. 7, that is arranged thereon.

The closed motion path 2.2 includes an outgoing linear section 5.1, a return linear section 5.2, and first and second deflection sections 6.1, 6.2 arranged between the outgoing and return linear sections 5.1, 5.2. The outgoing and return linear sections 5.1, 5.2 can comprise curved or oblique sections. Such curved or oblique sections are useful to compensate for a difference in height or to change a component of movement in the horizontal direction.

Both the motion elements 3 and the mechanical grippers 4 on the motion elements 3 can be individually controlled. As a result, in some cases, a motion element 3 can move at the same speed as its neighboring motion elements 3. However, in other cases, a motion element 3 can be accelerated or decelerated without the other motion elements doing the same. This means that not all motion elements 3 have to move at the same speed. Since the motion elements 3 can be controlled independently of one another, it is possible for motion elements 3 to all move at the same speed, or for individual ones of the motion elements 3 to speed up, to slow down, or to even briefly reverse direction of movement.

The ability to individually control motion elements 3 is particularly advantageous because it means that one can maintain the same overall throughput by deploying a smaller number of motion elements 3. This is because motion elements 3 moving along the a return linear section 5.2 can move much faster than the motion elements 3 moving on the outgoing linear section 5.1.

Most of the time, motion elements 3 circulate in a common direction A. However, if appropriate, motion elements 3 can also be moved individually and for short periods of time in a direction other than the common direction A. This might be carried out, for example, to change a distance between adjacent motion elements 3. It may also be carried out during particular steps of operation where rapid motion might be disadvantageous.

In the course of operation, there may be times when motion elements 3 must be removed for maintenance or inspection. There may also be times when fewer or more motion elements 3 are required to maintain an appropriate throughput. To permit insertion and removal of motion elements 3, some embodiments of the closed motion path 2.2 include an extraction lock arrangement that permits extraction of motion elements 3 that are either not required or that must be removed for inspection. This extraction lock arrangement also permits introduction of motion elements 3 or the return of motion elements 3 that had previously been removed for inspection or maintenance.

In some embodiments, the linear transporter comprises an electromagnetic track around which motion elements 3 circulate. In these cases, the linear transporter 2.1 can be an electromagnetic direct drive that causes a dynamically controllable electromagnetic field along a rail or track. Since the drive is electromagnetic, no gears are required. In such embodiments, a permanent magnet on the motion element 3 permits the motion element 3 to be moved in a controlled manner by a magnetic force.

The mechanical grippers 4 arranged at the motion elements 3 can carry out any movement in relation to the linear transporter 2.1 and also in relation to the motion element itself. Each mechanical gripper 4 can be actuated to move along or around any one of its degrees of freedom. In some embodiments, a central unit controls actuation of the mechanical grippers 4 and control of the motion elements 3.

As a motion element 3 traverses the closed motion path 2.2 of the linear transporter 2.1, it comes to a magazine 7 at the transfer station I. Within the magazine 7 are separating elements 10 that are to be picked up. The motion element's mechanical grippers 4 are arranged to participate in removal of a separating element 10 from the magazine 7.

Because each motion element 3 is individually controllable, it is possible to optimize the motion of the motion element 3 for picking up a separating element 10 without affecting motion of other motion elements 3. For example, it is possible to briefly stop the motion element 3, or to at least slow it down considerably, while the motion element 3 is in the transfer station I. This ensures that the mechanical gripper 4 can more reliably pick up a separating element 10.

In an alternative embodiment, the motion element's grippers 4 receive assistance from a circulating suction gripper 8. Like the motion element 3, the circulating suction gripper 8 is individually controllable. In this embodiment, the circulating suction gripper 8 picks up a flat-folded separating element 10 and transfers it to the motion element's mechanical grippers 4. This requires synchronizing the speeds of the motion element 3 and the circulating suction gripper 8 in the transfer region.

After having picked up a separating element 10, the motion element 3 brings it to an insertion station II. Again, as a result of the individual control over motion elements 3, it is possible to brake or even briefly stop the motion element 3 near the insertion station II. As a result, there is no need to have a predetermined distribution of driving carriers secured to a circulating chain.

The insertion station II is located above a transport plane 21 along which a divider 22 conveys receptacles 20 in groups or in channels in the transport direction B. Using divider-tools 24, the divider 22 divides the receptacles 20 into individual groups of receptacles that are to be placed into a container 23.

According to the exemplary embodiment from FIG. 1, the closed motion path 2.2 is perpendicular to the transport plane 21. In particular, the closed motion path 2.2 forms the boundary of an abstract surface. A first normal vector to this surface is perpendicular to a second normal vector that is normal to the transport plane 21. Of course, in reality there is no solid surface enclosed by the closed motion path 2.2. The notion of an abstract surface is merely a mathematical construct to provide a simple geometric way to define the orientations of the transport plane 21 and the closed motion path 2.2.

In the transfer station I, the separating elements 10 are taken out of the magazine 7 and transferred to the motion element 3 or taken up by its mechanical grippers 4.

Figure 2:
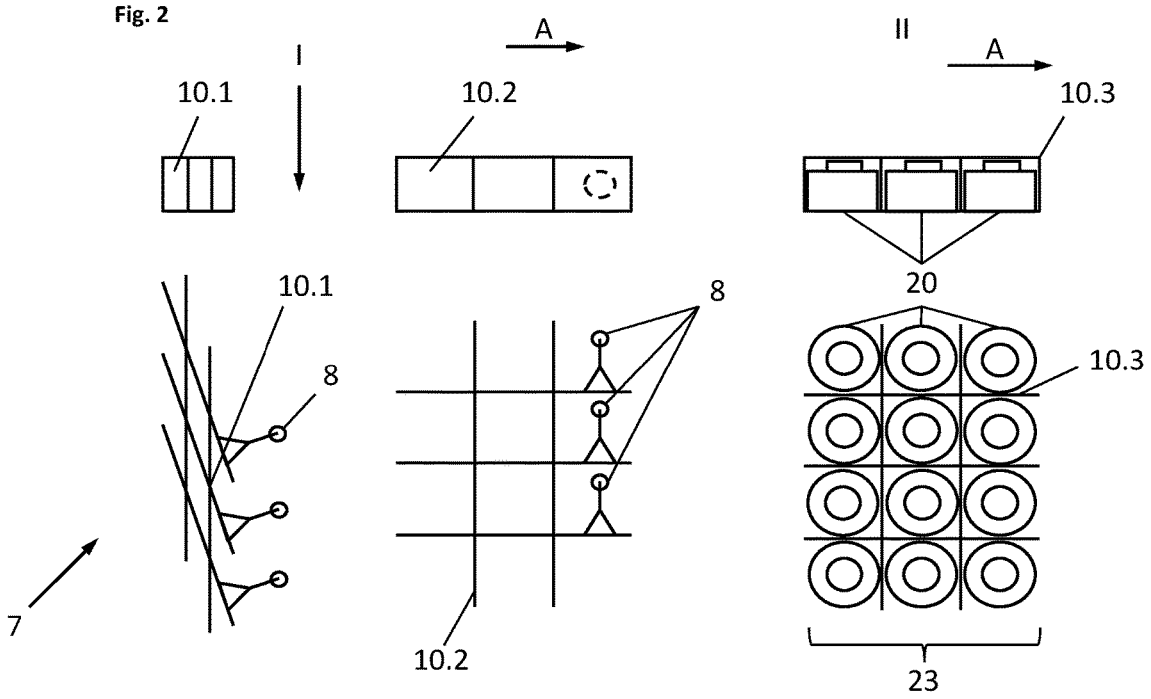
FIG. 2 shows the unfolding of a separating element as shown in FIG. 1.

As shown in FIG. 1 and schematically in FIG. 2, this procedure is carried by first using the circulating suction gripper 8 to unfold a flattened separating element 10.1. The motion element's mechanical gripper 4 then takes the unfolded separating element 10.2 and transports it the insertion station II. FIG. 2 shows another unfolded separating element 10.3 after having been placed into a waiting group of receptacles 20. Finally, the motion element 3 returns to its starting position to begin this procedure all over again.

In some cases, the circulating suction gripper 8 temporarily places the unfolded separating element 10 onto a movable platform 50 provided at the transfer station I. A mechanical gripper 4 secured to a motion element 3 that is approaching the platform 50 or that is already parked at the platform 50 then approaches the separating element 10 with its mechanical gripper 4 open to grip the separating element 10.

In an alternative embodiment, the motion element 3 and its mechanical grippers 4 form a platform 50 having fingers or webs. The unfolded separating element 10 is then placed onto the platform fingers or webs until the mechanical grippers 4 close. In this embodiment, the platform fingers or webs are ideally a part of the mechanical gripper 4.

In yet another embodiment, the mechanical gripper 4 takes the separating element 10 directly from the circulating suction gripper 8. This can be achieved as a result of the ability to individually control movement of the motion element 3, and in particular, by causing the motion element 3 to move slowly or even to stop briefly to pick up the separating element 10.

After the mechanical gripper 4 closes, the movable platform 50 and the mechanical gripper 4 move together to a handover section above a container 23. The mechanical gripper 4 then opens. As a result, the separating element 10 falls into the divided container 23.

Some embodiments also cause gaps to open between receptacles to facilitate insertion of the separating element 10. There are two kinds of gaps: those in which the long axis of the gap extends in the running direction and those in which the long axis is perpendicular to the running direction. To form the latter, one moves the base of the container 23 over a camber or hump. To form the former, one uses guide rails between individual rows of receptacles.

In some cases, the separating elements 10 are configured as frames. These frames are typically folded and laid flat in the magazine 7. A good way to pick up these frames is to use suction. As discussed above, a separate circulating suction gripper 8 can be used. However, in some embodiments, one or more grippers 4 on the motion element 3 are configured to carry out suction. Such a hybrid gripper 4 is therefore able to carry out both the function of mechanically gripping the frame and also picking it up in the first place by suction.

Figure 4:
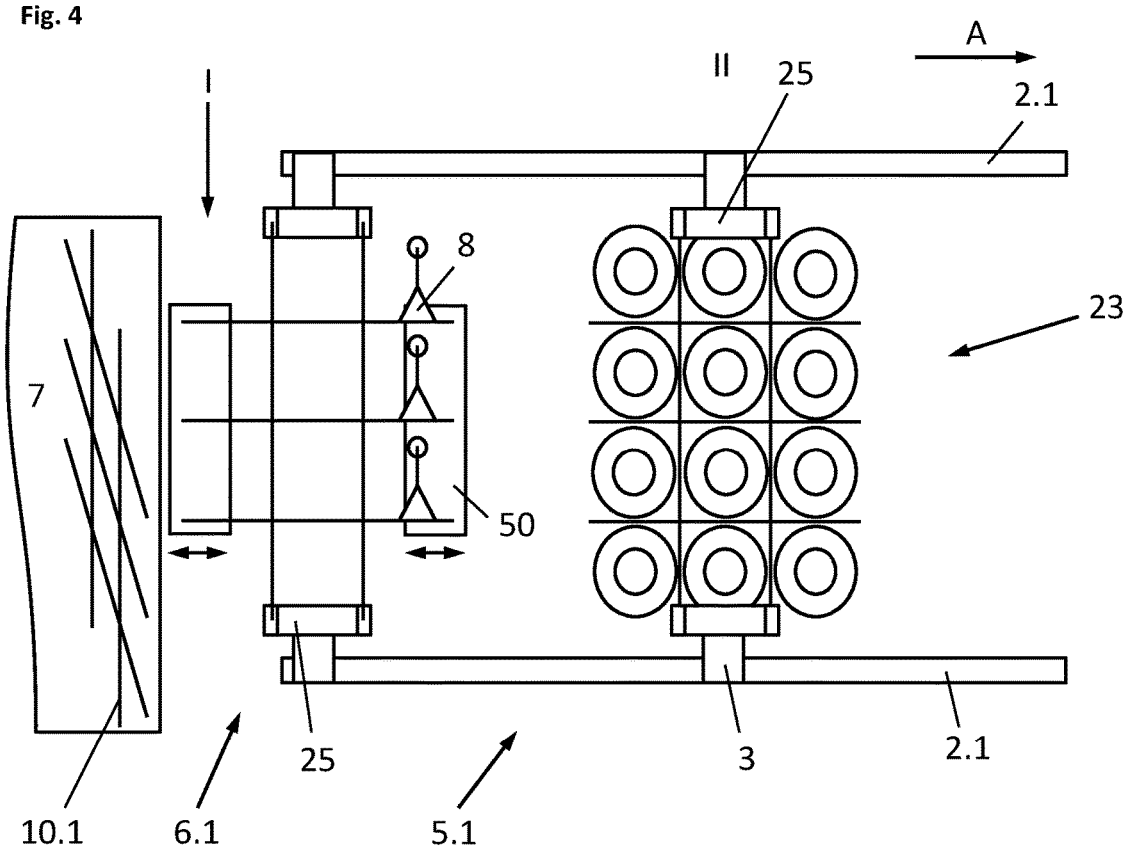
FIG. 4 shows a view from above the transfer station and the insertion station.

In some embodiments, there are several mechanical grippers 4 arranged at the motion elements 3. Relative motion between these mechanical grippers 3 enables them to unfold a frame while traveling along the outgoing linear section 5.1 and the first deflection section 6.1, as shown in FIG. 4.

Ideally, shortly before the insertion, the gripper 4 pivots or rotates to fully align the separating element 10. To achieve this, it is useful to transport the separating element 10 as far as possible in either a flattened format, in a fully folded state, or in an at least partially folded state to the transport device. A controller causes circulating suction grippers 8 mounted on the motion elements 3 to pivot or to rotate in a way that unfolds the separating elements 10. The controller causes this pivoting or rotating movement after the transfer station I, and in particular, shortly before the insertion station II.

A vacuum for the circulating suction grippers 8 can be arranged at the closed motion path 2.2. In some embodiments, the vacuum is supplied in a steady state, whereas in others, the motion element 3 carries a corresponding supply in a storage unit. Such a storage unit needs to be filled periodically. An optional access lock permits removal of the motion element 3 for refilling the storage unit and to return it after refilling.

In some embodiments, the storage unit is an energy storage unit. Function units that are arranged at the motion elements 3 can then draw on this energy in the course of their operation.

A particular advantage arises from the fact that the separating elements 10 do not have to be fully unfolded immediately. Instead, they can remain flat or partially unfolded until shortly before their insertion. This means that a delivery stretch can be shorter than those found in known separating-element inserters.

As a result of having motion elements 3 that circulate on a closed motion path 2.2 with mechanical grippers 4 to engage the separating elements 10, it becomes possible to transport the separating elements 10 without having to have them stand on a sliding track. In those embodiments in which the mechanical grippers 4 suspend the separating elements 10, it even becomes possible to dispense with the sliding track altogether. In these embodiments, the motion elements 3 hold the separating elements 10 hanging or upright.

Yet another advantage of the invention is the stability with which it becomes possible to transport separating elements 10. By using the methods and devices described herein, it becomes possible to avoid most friction, rotating, sliding, or any tendency to realign the separating element 10 into an undesirable position.

In some embodiments, it is preferable to align the separating element 10 into its desired position along the outgoing linear section 5.1. This can be carried out easily because the mechanical gripper 4 is free to move and because it is individually controllable at every point of the closed motion path 2.2. To facilitate such alignment, it is useful for either the mechanical gripper 4 or a take-up device thereof to be mounted on bearings on the motion element 3 such that a rotational or pivoting movement can be carried out. This movement orients the gripper element 4 differently relative to the motion element 3 or relative to the closed motion path 2.2.

The separating elements 10 are therefore transferred in the required position to the insertion station II. Once the separating element 10 has been transferred to the insertion station II, the controller accelerates the motion element 3. Ideally, it does so along the return linear section 5.2, and, if appropriate, along the second deflection section 6.2 so that the motion element 3 will be in position to engage a further separating element 10.

In some embodiments, the insertion station II is configured as a linear transporter 2.1, i.e. as an electromagnetic direct drive, just like the transport device 1. In such cases, motion elements 3 associated with the insertion station II also circulate on a closed motion path 2.2. All the embodiments relating to the transport device 1 apply by analogy to the insertion station II.

By means of the insertion station II, the separating elements 10 are conveyed as separated webs or frames to a container 23 that contains a group of receptacles 20. Preferably, the separating elements 10 are above the container 23. In this situation it is therefore appropriate for the insertion station II to be arranged above the moving containers 23. Either the closed motion path 2.2 of the transport device 1 or that of the insertion station II can be used to carry out the necessary height equalization.

The motion elements 3 of the insertion station II can comprise a gripper 4 that introduces a correctly-aligned separating element 10 into a container 23 that contains a group of receptacles 20. This means that the separating elements 10 are not simply released and allowed to fall into the container 23. Instead, the gripper 4 applies a force to insert the separating elements 10 into the container 23. This places the separating element 10 into the required position relative to the group of receptacles 20 within the container 23 in a way that is relatively immune to the vagaries associated with merely letting the separating element 10 fall into place.

In those embodiments in which the insertion station II also features a linear transporter 2.1, the linear transporters 2.1 of the transport device 1 and of the insertion station II are grouped together to form one common linear transporter 2.1. This is possible because the closed motion paths 2.2 are individually configurable and can be joined and because motion element 3 and their grippers 4 can be individually controlled.

In this situation, the closed motion path 2.2 can again comprise an outgoing linear section 5.1 that leads to a transfer section I at which the separating elements 10 are taken out of a separating element magazine 7, if appropriate unfolded, and carried by motion elements 3 that can be sped up and/or slowed down and that can have their grippers 4 aligned as they move along the closed motion path 2.2. The same motion elements 3 can then insert the separating elements 10 into waiting containers 23. For this purpose, the grippers 4 are configured to carry out all the functions referred to above, together with the function of actually inserting the separating element 10 into a waiting container 23. This results in a combination gripper element that not only takes up, transports, aligns, and stops the separating element 10 but that also specifically inserts the separating element 10 into a waiting container 23.

Figure 3:
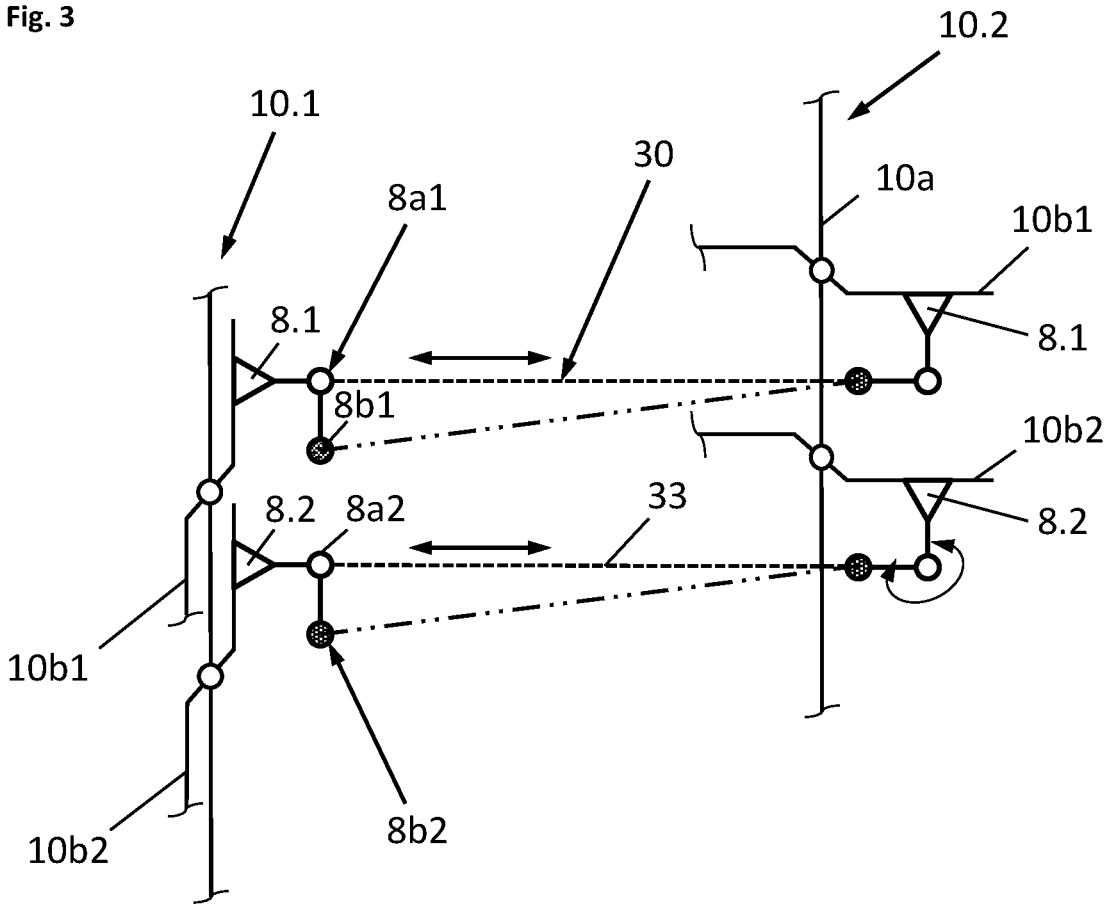
FIG. 3 shows suction grippers of FIG. 1 unfolding a separating element.

FIG. 3 shows how first and second suction grippers 8.1, 8.2 cooperate to unfold a separating element 10. The first suction gripper 8.1 engages a first web **10*b*1 of the flat separating element 10.1, and a second suction gripper 8.2 engages a second web 10*b*2. The first suction gripper 8.1 rotates about a first pivot point 8*a*1 that can be moved along a first motion path 33.1 A first guide element 8*b*1 coupled to first pivot point 8*a*1 permits it to control rotation of the first suction gripper 8.1 about the first pivot point 8*a*1. Meanwhile, the second suction gripper 8.2 rotates about a second pivot point 8*a*2 that can be moved along a second motion path 33.2 A second guide element 8*b*2 coupled to second pivot point 8*a*2 permits it to control rotation of the second suction gripper 8.2 about the second pivot point 8*a*2**.

A suitable drive and control element drives the first and second guide elements **8*b*1, 8*b*2 to cause a defined rotation of the corresponding first and second suction grippers 8.1, 8.2 about their corresponding first and second pivot points 8*a*1, 8*a*2. At the completion of the unfolding process, shown on the right-side of FIG. 3, the first and second suction grippers 8.1, 8.2 have been arranged in relation to one another in such a way that the first and second webs 10*b*1, 10*b*2 of the separating element 10 now stand approximately perpendicular to a jointed transverse webs 10*a* connected to the first and second webs 10*b*1, 10*b*2**.

In a view from above, FIG. 4 shows a linear transporter 2.1 extending between the transfer station I and the insertion station II. The figure catches the apparatus just as a first motion element on the left side of the figure has picked up and unfolded a separating element from a stack of folded separating elements 10.1 in a magazine 7 and a second motion element 3 to the right of the first motion element 3 has just placed a separating element 10.2 into a waiting container 23.

FIG. **5*a* shows the detailed structure of a motion element 3 having first and second grippers 4*a*, 4*b*. The structure includes a carrier 25 having a central section 26, a first outer section 27, and a second outer section 28. A rotatable actuator 29 mounted to the central section 26 couples to the first and second outer sections 27, 28 by coupling elements 30. Each of the first and second outer sections 27, 28 rides on a corresponding guide bar 31. As a result, the first and second outer sections 27, 28** are movable in a lateral direction.

The illustrated motion element 3 features two active grippers **4*a*. Each active gripper 4*a* is made up of a first gripper arm 4.1 and a second gripper arm 4.2. The first gripper arm 4.1 is on the central section 25 whereas the second gripper arm 4.2 is on a corresponding one of the first and second outer sections 27, 28**.

As the actuator 29 rotates, it moves the first and second carrier sections either inward or outward in the transverse direction. This controls whether or not the first and second active grippers **4*a*** are open or closed.

FIG. **5*a* shows the actuator 29 oriented so that the first and second sections 27, 28 are as far apart as possible. In this position, each of the first and second gripper arms 4.1, 4.2 are far apart. As a result, the active grippers 4*a* are wide open and ready to accept corresponding web sections 10*b*1, 10*b*2**.

Figure 5A:
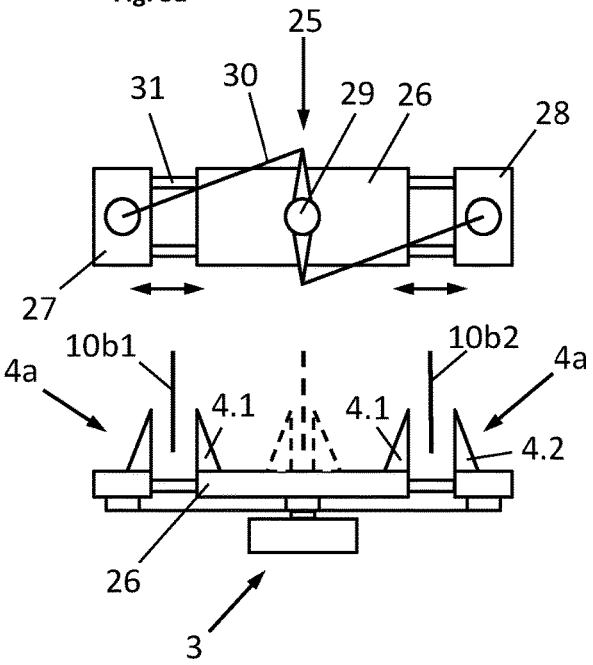
FIGS. 5*a* and 5*b* show schematic representations of the motion element and a mechanical gripper.
Figure 5B:
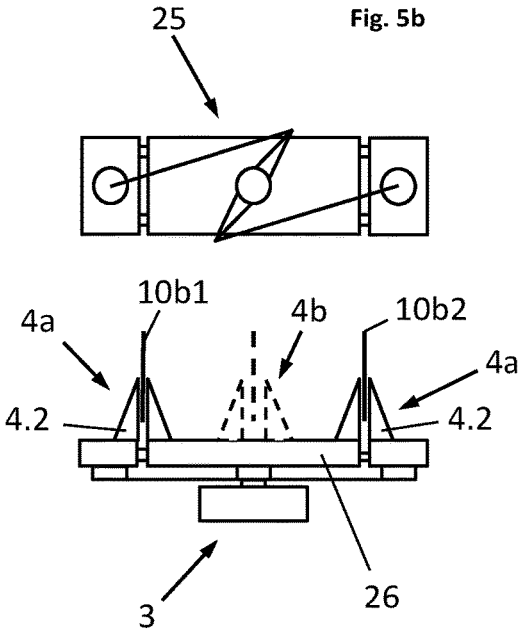

In contrast, FIG. **5*b* shows the actuator 29 oriented so that the first and second sections 27, 28 are as close together as possible. In this position, each of the first and second gripper arms 4.1, 4.2 are able to grip the corresponding web sections 10*b*1, 10*b*2 that were offered to the active grippers 4*a* in FIG. 5*b***.

Dashed lines in FIGS. **5*a* and 5*b* illustrate the possibility of a passive gripper 4*b* on the central section 26. Unlike the active grippers 4*a*, whose arms move in response to rotation of the actuator 29, the arms of the passive gripper 4*b* do not move. Instead, the passive gripper 4*b*** serves as a guide by accommodating a further web section, also shown in dashed lines, between its permanently open arms.

FIG. **6*a* shows a central adjustment unit for two grippers 4*a*, each of which is shown engaging a corresponding web 10*b*1, 10*b*2. The grippers 4*a* are disposed symmetrically around a central plane M that bisects the motion element 3. Each gripper 4*a* is mounted to a spindle or threaded rod 32 such that rotation of the threaded rod 32 about a rod axis GA thereof causes the gripper 4*a*** to be displaced along the rod axis GA. In some embodiments, more than one spindle or threaded rod can be used.

Figure 6A:
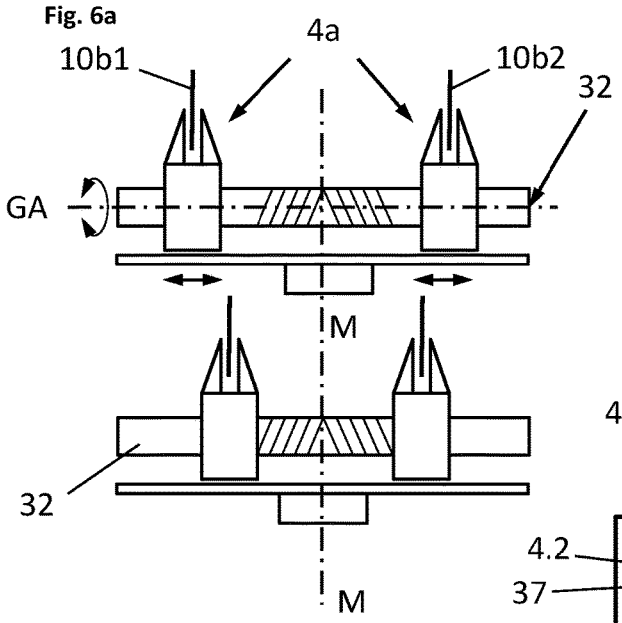
FIGS. 6*a* and 6*b* show alternative mechanical grippers of a motion element.
Figure 6B:
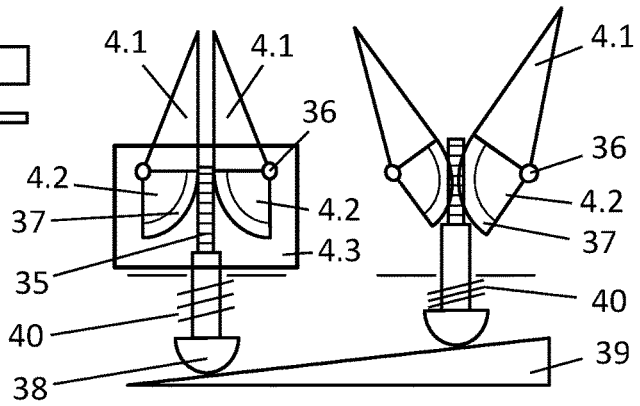

The threaded rod 32 has threads that are pitched one way on a first side of the central plane M and pitched in the opposite way on a second side of the central plane M. This results in counter-running threads. As a result, rotating the threaded rod 32 about its axis GA leads to a symmetrical parallel change in the interval spacing of the two grippers **4*a* in relation to one another with the two grippers 4*a* remaining symmetrical relative to the central plane M. Rotating the threaded rod 32 is therefore an easy way to adjust the gripper spacing to accommodate different separating elements 10 with different distances between their webs 10*b*1, 10*b*2. For example, the lower portion of FIG. 6*a* shows the gripper arms 4*a* adjusted to be closer to each other to accommodate separating elements 10** with smaller inter-web spaces.

FIG. **6*b* shows an alternative gripper 4 having gripper arms 4.1 and drive ends 4.2 that are mounted to pivot around corresponding pivot axes 36. Each drive end 4.2 has defines a curve-shaped contour with a toothed surface 37. The toothed surface 37 engages a linear displaceable toothed or threaded rod 35. As a result, displacing the threaded rod 35 up and down operates to open and close the gripper arms 4.1**.

The threaded rod 35 has a plunger 38 mounted on a lower end thereof. The plunger 38 engages an guide track 39 having an incline. As a result, it is possible to displace the threaded rod 35 upwardly by causing the plunger 38 to move relative to the guide track 39 in a direction that results in the plunger 38 climbing the guide track's. To displace the threaded rod 35 downward, the plunger 38 moves in the opposite direction so that it now descends the incline. A spring 40 disposed to urge the plunger 38 downward assists in this downward displacement of the threaded rod 35.

In the alternative embodiment of FIG. 7, the closed motion path 2.2 is parallel to the transport plane 21. In particular, the closed motion path 2.2 forms the boundary of an abstract surface. A first normal vector to this surface is parallel to a second normal vector that is normal to the transport plane 21. Of course, in reality there is no solid surface enclosed by the closed motion path 2.2. The notion of an abstract surface is merely a mathematical construct to provide a simple geometric way to define the orientations of the transport plane 21 and the closed motion path 2.2.

The various components in FIG. 7 function in a manner that is entirely analogous manner to that already described in connection with claim 1.

In addition, the linear transporter 2.1 can have portions that are above the transport plane 21 and portions that are below the transport plane 21. Ideally, the insertion station II and the portion of the linear transporter associated with the insertion station II is arranged above the container 23 and hence above the transport plane 21.

The apparatus described herein can be used in cases in which the container 23 has as outer covering, a carton or other closable transport enclosures. In such cases, the separating element 11 is inserted into containers 23 that are subsequently enclosed by a film.

Having described the invention, and a preferred embodiment thereof, what is claimed as new, and secured by Letters Patent is:

1. An apparatus comprising a plurality of motion elements, each of which has grippers arranged thereon, and an electromagnetic direct drive, wherein each motion element is configured to take up a separating element from a stack of separating elements, to bring said separating element to a container that contains a receptacle group that comprises a plurality of receptacles, adjacent ones of which are to be separated by said separating element, and to insert said separating element into said container, thereby separating adjacent ones of said receptacles, wherein said electromagnetic direct drive comprises a closed motion path on which said motion elements circulate in a common direction, and wherein each motion element from said plurality of motion elements is individually actuatable along said closed motion path independently of other motion elements from said plurality of motion elements, said apparatus further comprising a suction gripper configured to unfold a flattened separating element thereby forming an unfolded separating-element, wherein said suction gripper is configured to place said unfolded separating-element onto a movable platform, wherein said motion element is configured to approach said platform and to grip said separating element with one of said first and second grippers.

2. The apparatus of claim 1, wherein said closed motion path comprises an outgoing side, a return side, and first and second deflection regions arranged between said return side and said outgoing side and wherein each of said motion elements is configured to take up said separating element at said first deflection region, to carry said separating element along said return side, and to bring said separating element to said container while said motion element is traveling along said return side.

3. The apparatus of claim 1, wherein said plurality of motion elements comprises a first motion element having a first gripper arranged thereon, wherein said first gripper is movable relative to said first motion element.

4. The apparatus of claim 1, wherein said grippers comprise a first gripper and a second gripper, wherein said first gripper is controllable independently of said second gripper and wherein said first and second grippers open and close independently of each other.

5. The apparatus of claim 1, further comprising a magazine that holds a stack of separating elements, wherein each of said motion elements is configured to take up a separating element from said stack and to bring said separating element to said container, and wherein said separating element is configured as a frame.

6. The apparatus of claim 1, further comprising an insertion station, wherein said insertion station comprises a portion of said electromagnetic direct drive and wherein while a movement element is traveling along said insertion station at the same velocity as said container, said movement element inserts said separating element into said container as said container moves past said insertion station.

7. The apparatus of claim 1, further comprising a divider that conveys receptacles and a divider tool that divides said receptacles being conveyed by said divider into groups of receptacles.

8. The apparatus of claim 1, wherein each of said motion elements comprises a platform for receiving a separating element.

9. The apparatus of claim 1, wherein said grippers and said motion element define a platform for receiving a separating element.

10. The apparatus of claim 1, wherein said grippers on said motion elements are controlled independently of one another.

11. The apparatus of claim 1, wherein said closed motion path comprises an outgoing side, a return side, and first and second deflection regions arranged between said return side and said outgoing side, wherein each of said motion elements takes up a separator while traversing said first deflection region and inserts said separator while traversing said outgoing side, and wherein each of said motion elements traverses said return side, said second deflection region, and at least part of said outgoing side without carrying a separator.

12. An apparatus for transporting a separating element and inserting a separating element into a container containing a receptacle group that comprises a plurality of receptacles, adjacent ones of which are to be separated by said separating element, said apparatus comprising a transport device configured to pick up said separating element and to bring said separating element to said container, wherein said transport device comprises an electromagnetic direct drive and a plurality of motion elements, wherein said electromagnetic direct drive comprises a closed motion path on which said motion elements circulate in a common direction, wherein each motion element from said plurality of motion elements comprises a gripper arranged thereon, and wherein each of said motion elements comprises a carrier having a central section and first and second outer sections, a rotatable actuator mounted on said central section and coupled to said outer sections by coupling elements, and first and second guide bars upon which said first and second outer sections ride, whereby said first and second outer sections are laterally movable towards and away from said central section.

13. The apparatus of claim 12, wherein each gripper comprises first and second gripper arms, wherein said first gripper arm is on said central section and said second gripper arm is on one of said first and second outer sections.

14. The apparatus of claim 12, wherein said grippers are configured to remove said separating elements from a magazine and, as a result of relative movement between said grippers, to unfold said separating element.

15. The apparatus of claim 12, wherein said grippers comprise a first gripper and a second gripper, wherein said first gripper is controllable independently of said second gripper and wherein said first and second grippers open and close independently of each other.

16. The apparatus of claim 12, wherein said grippers are configured to remove said separating elements from a magazine and, as a result of relative movement between said grippers, to unfold said separating element.

17. The apparatus of claim 12, wherein said grippers on said motion elements are controlled independently of one another.

18. The apparatus of claim 12, wherein said closed motion path comprises an outgoing side, a return side, and first and second deflection regions arranged between said return side and said outgoing side, wherein each of said motion elements takes up a separator while traversing said first deflection region and inserts said separator while traversing said outgoing side, and wherein each of said motion elements traverses said return side, said second deflection region, and at least part of said outgoing side without carrying a separator.

19. An apparatus for transporting a separating element and inserting a separating element into a container containing a receptacle group that comprises a plurality of receptacles, adjacent ones of which are to be separated by said separating element, said apparatus comprising a transport device configured to pick up said separating element and to bring said separating element to said container, wherein said transport device comprises a plurality of motion elements and an electromagnetic direct drive and comprising a closed motion path on which said motion elements circulate in a common direction, wherein each motion element from said plurality of motion elements comprises a gripper arranged thereon, said apparatus further comprising a threaded rod, wherein said first and second mechanical grippers are disposed symmetrically around a central plane that bisects the motion element and mounted on opposite ends of said threaded rod such that rotation of said threaded rod displaces said first and second grippers along a rod axis of said threaded rod and wherein said threaded rod has threads that are pitched one way on a first side of said central plane and pitched in an opposite way on a second side of said central plane, as a result of which rotating said threaded rod about said rod axis causes said grippers to move relative to said axis by the same amount.

20. The apparatus of claim 19, further comprising a suction gripper configured to unfold said separating element.

21. The apparatus of claim 19, further comprising a circulating suction gripper configured to pick up a flat and folded separating element and to transfer said separating element to said grippers, wherein speeds of said motion element and said circulating suction gripper are synchronized.

22. The apparatus of claim 19, further comprising suction grippers configured to pick up a folded separating element and to unfold said separating element.

23. The apparatus of claim 19, wherein said motion elements comprise carriages.

24. The apparatus of claim 19, wherein said closed motion path comprises an outgoing side, a return side, and first and second deflection regions arranged between said return side and said outgoing side and wherein each of said motion elements is configured to take up said separating element at said first deflection region, to carry said separating element along said return side, and to bring said separating element to said container while said motion element is traveling along said return side.

* * * * *